US007847493B2

(12) United States Patent
Shen et al.

(10) Patent No.: US 7,847,493 B2
(45) Date of Patent: Dec. 7, 2010

(54) DETECTING LAMP CURRENTS AND PROVIDING FEEDBACK FOR ADJUSTING LAMP DRIVING VOLTAGES

(75) Inventors: Li-Ho Shen, Tainan (TW); Yu-Lin Liu, Tainan (TW)

(73) Assignee: Chimei Innolux Corporation (TW)

( * ) Notice: Subject to any disclaimer, the term of this patent is extended or adjusted under 35 U.S.C. 154(b) by 225 days.

(21) Appl. No.: 11/450,510

(22) Filed: Jun. 9, 2006

(65) Prior Publication Data

US 2006/0284575 A1 Dec. 21, 2006

(30) Foreign Application Priority Data

Jun. 15, 2005 (TW) ..... 94119910 A

(51) Int. Cl.
*G05F 1/00* (2006.01)
*H05B 37/00* (2006.01)

(52) U.S. Cl. ..... 315/312; 315/307

(58) Field of Classification Search ..... 315/307, 315/312, 213, 220, 224, 226, DIG. 2, DIG. 5
See application file for complete search history.

(56) References Cited

U.S. PATENT DOCUMENTS

| | | | | |
|---|---|---|---|---|
| 7,012,578 | B2 * | 3/2006 | Nakatsuka et al. | 345/52 |
| 7,164,240 | B2 * | 1/2007 | Moyer et al. | 315/255 |
| 7,183,727 | B2 * | 2/2007 | Ferguson et al. | 315/308 |
| 7,205,724 | B2 * | 4/2007 | Ahn et al. | 315/209 R |
| 7,230,390 | B2 * | 6/2007 | Wu | 315/213 |
| 7,294,971 | B2 * | 11/2007 | Jin | 315/177 |
| 7,332,867 | B2 * | 2/2008 | Cho | 315/209 R |
| 7,391,166 | B2 * | 6/2008 | Ushijima et al. | 315/276 |
| 2004/0246226 | A1 * | 12/2004 | Moon | 345/102 |
| 2005/0269973 | A1 * | 12/2005 | Jang et al. | 315/307 |

FOREIGN PATENT DOCUMENTS

| | | |
|---|---|---|
| CN | 1515940 | 7/2004 |
| JP | 8166575 | 6/1996 |
| JP | 2000231998 | 8/2000 |
| TW | 200303626 | 9/2003 |
| TW | 200537987 | 11/2005 |

* cited by examiner

*Primary Examiner*—Douglas W Owens
*Assistant Examiner*—Minh D A
(74) *Attorney, Agent, or Firm*—Trop Pruner & Hu, P.C.

(57) ABSTRACT

A lamp current of a lamp with at least one high-voltage end is detected using a current detector connected to the high-voltage end of the lamp. A feedback signal according to the lamp current is generated, and a drive voltage to the lamp is adjusted according to the feedback signal.

15 Claims, 4 Drawing Sheets

DETECTING LAMP CURRENTS AND PROVIDING FEEDBACK FOR ADJUSTING LAMP DRIVING VOLTAGES

CROSS REFERENCE TO RELATED APPLICATION

This claims priority under 35 U.S.C. §119 of Taiwan patent application No. 94119910, filed Jun. 15, 2005.

TECHNICAL FIELD

The invention relates generally to detecting lamp currents and providing feedback for adjusting lamp driving voltages.

BACKGROUND

FIG. 1 is a block diagram of a signal-drive current feedback circuit for a lamp 130 (or plural lamps) of a conventional backlight module 100. The backlight module 100 outputs a voltage (labeled AC in FIG. 1) from a control integrated circuit (IC) 110. The voltage AC is converted by a transformer 120 to a driving voltage AC' for driving the lamp 130. The lamp 130 is a single-drive lamp (which is driven on one side of the lamp, with the other side of the lamp grounded as depicted in FIG. 1. The backlight module 100 has a feedback circuit 140 that detects lamp current Id flowing to the lamp 130. The feedback circuit 140 is coupled to one end of a secondary coil 122 of the transformer 120, and provides a feedback voltage Vfb to the control IC 110 accordingly. The control IC 110 changes the voltage AC according to comparison of the feedback voltage Vfb and a reference voltage Vref, and thus adjusts the driving voltage AC' so that the luminance of the lamp 130 can be maintained at a target value.

A high-voltage end HE of the single-drive lamp 130 is coupled to the secondary coil 122 of the transformer 120, while a low-voltage end LE of the lamp 130 is coupled to the ground voltage. Furthermore, the feedback circuit 140 has one end coupled to the secondary coil 122 and the other end coupled to the grounded low-voltage end LE of the lamp 130. To allow a more stable lamp current Id to be detected by the feedback circuit 140, the high-voltage end HE of the lamp 130 is coupled to an additional capacitor C. With such a feedback circuit connection, since a part (Ic) of the lamp current Id flows through the capacitor C, the current actually driving the lamp 130 is a remaining portion Id' of the current Id (in other words, Id'=Id−Ic). Therefore, the current Id detected by the feedback circuit 140 is not the actual current Id' for driving the lamp 130, which reduces the detection accuracy of the feedback circuit 140.

Additionally, resistor devices (not shown) of the conventional feedback circuit 140 are unable to withstand the high voltages (thousands of volts) that are typically associated with the high-voltage end HE of the lamp 130. As a result, feedback circuit 140 is usually connected to the low-voltage end LE of the lamp 130 (through the ground connection depicted in FIG. 1). Such a feedback circuit 140 cannot usually be used with floating lamps (or dual-drive lamps) used in some conventional backlight modules.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

In accordance with some embodiments, a feedback circuit is provided for use in a light module (e.g., a backlight module) that has one or more lamps. The feedback circuit detects current(s) of the lamp(s) and produces a feedback for adjusting the driving voltage(s) of the lamp(s). The feedback circuit can be connected to the high-voltage end of a lamp to improve flexibility and accuracy when providing feedback for adjusting the driving voltage(s).

Figure 2:
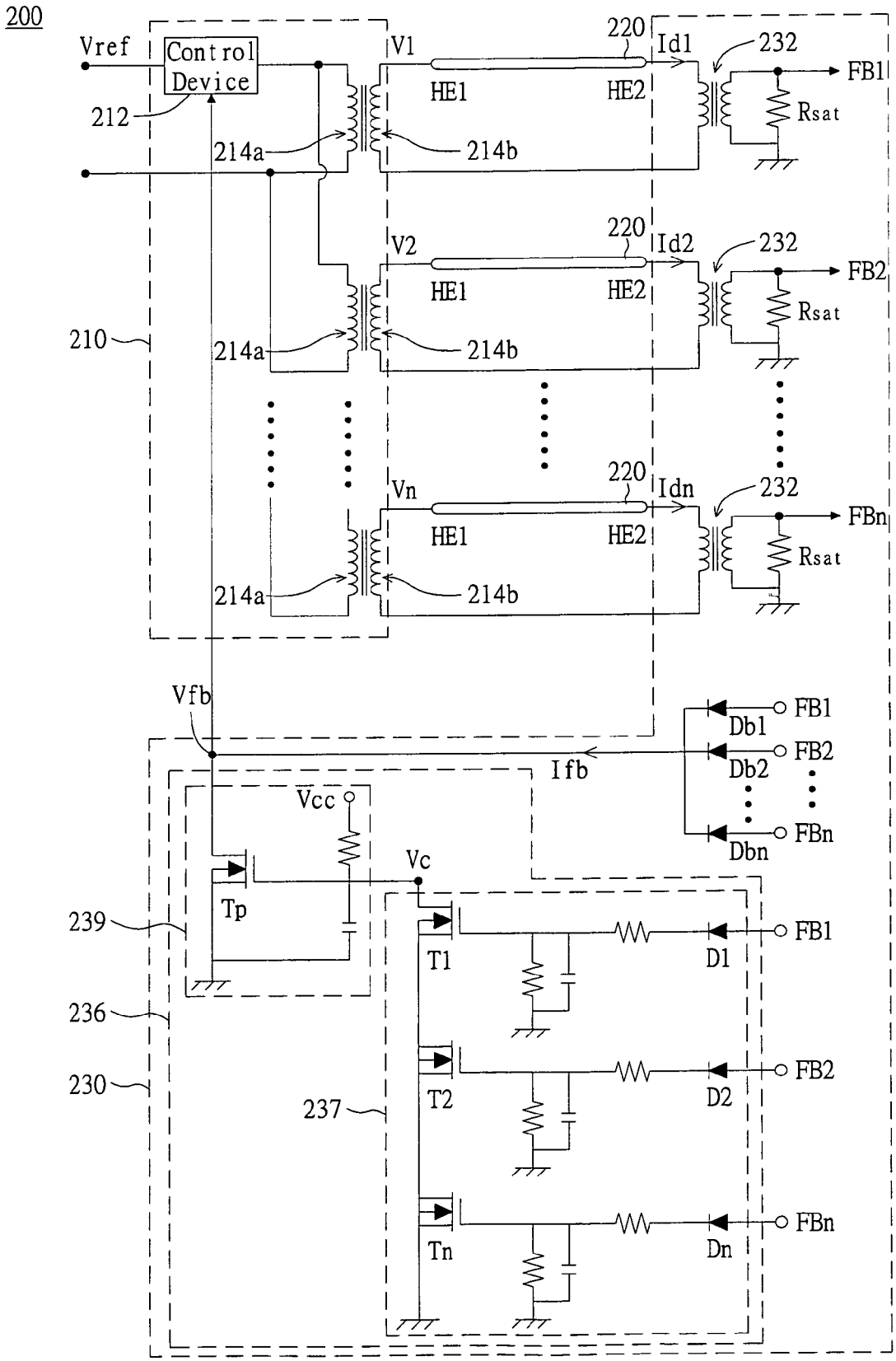
FIG. 2 is a circuit diagram of a backlight module including a feedback circuit according to an embodiment.

Referring to FIG. 2, a circuit diagram of a backlight module according to an embodiment is shown. The backlight module 200 supplies backlight for a liquid crystal display (LCD) module, for example. In other embodiments, the backlight module 200 can be used for other applications. Although reference is made to backlight modules, it is noted that techniques according to some embodiments can be used with other types of light modules. The backlight module 200 includes an inverter 210, n (n is a positive integer) lamps, and a feedback circuit 230. The lamps 220 according to one example implementation are floating lamps (also referred to as dual-drive lamps that are driven with high voltages at both ends of each lamp). Each lamp 220 has two high-voltage ends HE1 and HE2. The high voltages applied to the two ends HE1 and HE2 of each lamp 220 have generally the same magnitude, but have opposite polarities. A dual-drive lamp is contrasted to single-drive lamp, which is driven with a high voltage at one end, with the other end of the single-drive lamp grounded. Some lamps, such as CCFL lamps, can be used in either of two modes—a single-drive mode and a dual-drive mode. Although described primarily in the context of dual-drive lamps (or floating lamps), it is noted that techniques according to other embodiments can also be applied to single-drive lamps.

The inverter 210 outputs respective driving voltages V1~Vn to the n lamps 220. The inverter 210 further includes a control device (such as a control integrated circuit (IC) device) 212 and n transformers 214 coupled in parallel to each other. Each transformer 214 has a primary coil 214*a* and a secondary coil 214*b*, and each secondary coil 214*b* is correspondingly coupled to a first high-voltage end HE1 of a corresponding lamp 220. The control device 212 outputs a voltage AC to the primary coils 214*a* of the transformers 214. In response to the AC voltage supplied to the primary coils 214*a*, driving voltages V1~Vn are induced at respective secondary coils 214*b*, which driving voltages light up respective lamps 220.

The feedback circuit 230 is connected to the other high-voltage end HE2 of each lamp 220 and to the inverter 210 for detecting the lamp currents Id1~Idn of the corresponding n lamps 220. According to the detected lamp currents, the feedback circuit 230 provides a feedback voltage Vfb (more generally referred to as a feedback indication) to the control device 212 in the inverter 210. The control device 212 changes the driving voltages V1~Vn to adjust the luminance of the lamps 220 according to the comparison of the feedback voltage Vfb and a reference voltage Vref.

The feedback circuit 230 includes n current transformers 232, n diodes Db1~Dbn, and a protection unit 236. The n transformers 232 are connected to the high-voltage ends HE2 of the respective n lamps 220 (and to the inverter 210) for receiving the corresponding lamp currents Id1~Idn and outputting corresponding current signals FB1~FBn accordingly. In other words, the current signals FB1~FBn outputted by the current transformers 232 are based on the lamp currents Id1~Idn. Effectively, the current transformers 232 constitute current detectors in accordance with an embodiment.

The anodes of the n diodes are respectively used for receiving the current signals FB1~FBn, and the cathodes of the n diodes Db1~Dbn are connected to each other and to the feedback voltage Vfb.

In addition, the protection unit 236 includes a feedback switch device 237 and a protection switch device 239. The feedback switch device 237 is coupled to the n current transformers 232 for receiving the current signals FB1~FBn and outputting a control voltage Vc accordingly. The protection switch device 239 includes an N-type metal oxide semiconductor (NMOS) transistor Tp. The gate of the transistor Tp is coupled to an operational voltage Vcc via a resistor and receives the control voltage Vc, the source of the transistor Tp is grounded, and the drain of the transistor Tp is connected to the feedback voltage Vfb (and is coupled to the control device 212).

When all the lamps 220 are operated in a normal state (a conductive state), the n current transformers 232 respectively output non-zero current signals FB1~FBn according to the lamp currents Id1~Idn. A "normal state" of a lamp refers to a state of the lamp when the lamp is functional and non-defective—in other words, the lamp is conductive such that a current Idx (x=1~n) passes through the lamp. The current signals FB1~FBn flowing to the feedback switch device 237 respectively flow to the gates of the NMOS transistors T1~Tn via diodes D1~Dn in the feedback switch device 237. Since the current signals FB1~FBn are not zero, the gate voltage of the transistor Tn is higher than the ground level of its source and thus the transistor Tn is turned on. As a result, the transistors Tn−1 (the transistor connected to the drain of the transistor Tn), . . . , T2 and T1 are sequentially turned on to ground the control voltage Vc. Once all transistors T1 to Tn are turned on, the gate voltage of the transistor Tp in the protection switch device 239 is grounded by the control voltage Vc and thus the transistor Tp is turned off.

The current signals FB1~FBn provided to the n diodes Db1~Dbn (which are coupled in parallel to each other) causes a maximum current signal Imax=max {FB1, . . . , FBn} (Imax≠0) to be output as Ifb from the collection of the n diodes Db1~Dbn. The Imax current is equal to the maximum of FB1, . . . FBn. The Imax current causes production of the feedback voltage Vfb (≠0) to the control device 212. In this manner, the control device 212 adjusts the luminance of the lamps 220 according to the comparison of the feedback voltage Vfb and the reference voltage Vref.

The above discusses the scenario in which all lamps 220 are operating normally. If at least one (such as the second one) of the lamps 220 is broken down (not functioning properly and in a non-conductive state), the corresponding lamp current Id2 is zero, and thus the current signal FB2 induced by the respective current transformer 232 is also zero. The feedback current Ifb is still the maximum value Imax of the current signals FB1~FBn. However, in this scenario (where one of the lamps is non-functional), the feedback voltage Vfb is determined not by Ifb, but by the output voltage of the protection unit 236. Because the signal FB2 is zero, the corresponding transistor T2 in the feedback switch device 237 has a zero gate voltage. Therefore, although the transistors T3~Tn are turned on to ground the source of the transistor T2, the gate voltage of the transistor T2 is at zero and thus the transistor T2 remains turned off. This results in the whole feedback switch device 237 remaining off to leave Vc un-driven by the feedback switch device 237. However, the gate voltage of the transistor Tp in the feedback switch device 239 is pulled to the Vcc voltage by the pull-up resistor, which causes the gate voltage of the transistor Tp to be higher than the grounded source voltage. As a result, the transistor Tp is turned on to ground the feedback voltage Vfb.

Upon detecting that Vfb is at a ground voltage, the control device 212 determines that at least one of the lamps 220 is abnormal and immediately stops outputting the driving voltages V1~Vn (to turn off the lamps) to prevent damage to the rest of the backlight module 220.

The feedback circuit 230 according to the embodiment discussed above uses the current transformers 232 whose input and output ends have superior isolation effect to provide the current signals FB1~FBn for feedback. Consequently, the feedback current Ifb can be obtained more accurately. Furthermore, the feedback circuit 230 of the backlight module 200 detects the currents at the high-voltage ends HE2 of the lamps 220 for feedback, which can be used for current detection of floating (dual-drive) lamps.

Although specific circuitry, including diodes and specific types of transistors, are depicted in the feedback circuit 230 in FIG. 2, it is noted that other circuitry can be used in other embodiments. More generally, the feedback circuit connected to a high-voltage end of a lamp has a current detector to detect a current of a lamp. The feedback circuit further includes a protection unit for detecting when at least one lamp is non-functional (such as based on detecting that the current from the non-functional lamp is zero), in which case the protection unit causes the feedback voltage Vfb (or other type of feedback indication) to have a predefined value (e.g., a ground voltage). This predefined value is detected by a control device to enable the control device to disable all lamps to avoid or reduce likelihood of damage to the lamps.

Figure 1:
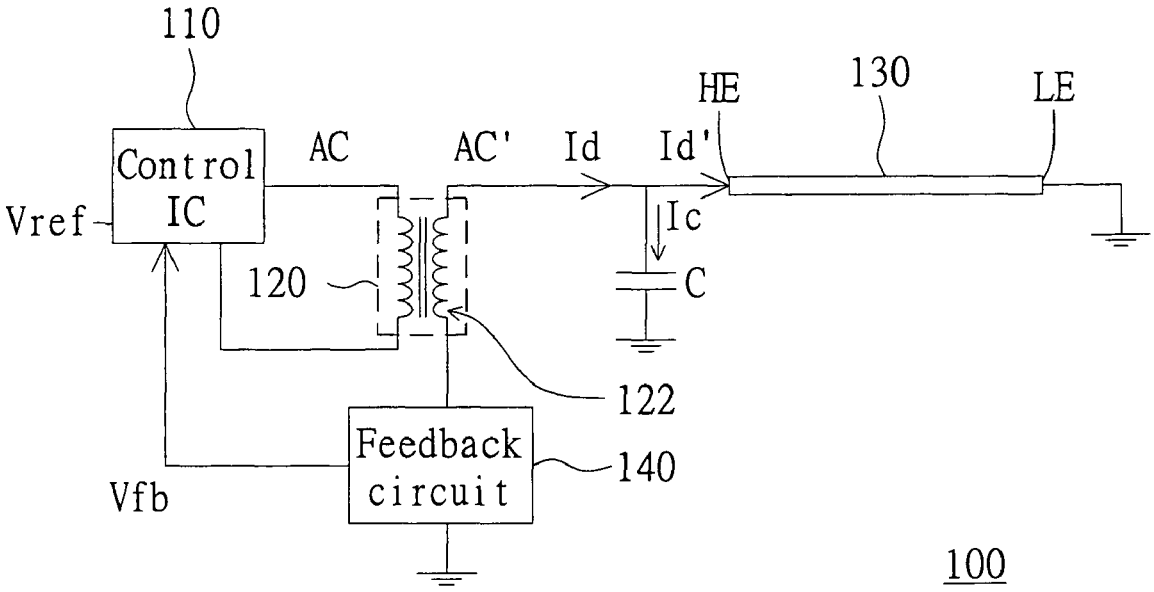
FIG. 1(PRIOR ART)
FIG. 1 is a circuit diagram of a conventional backlight module that has a feedback circuit for lamps in the backlight module.
Figure 3:
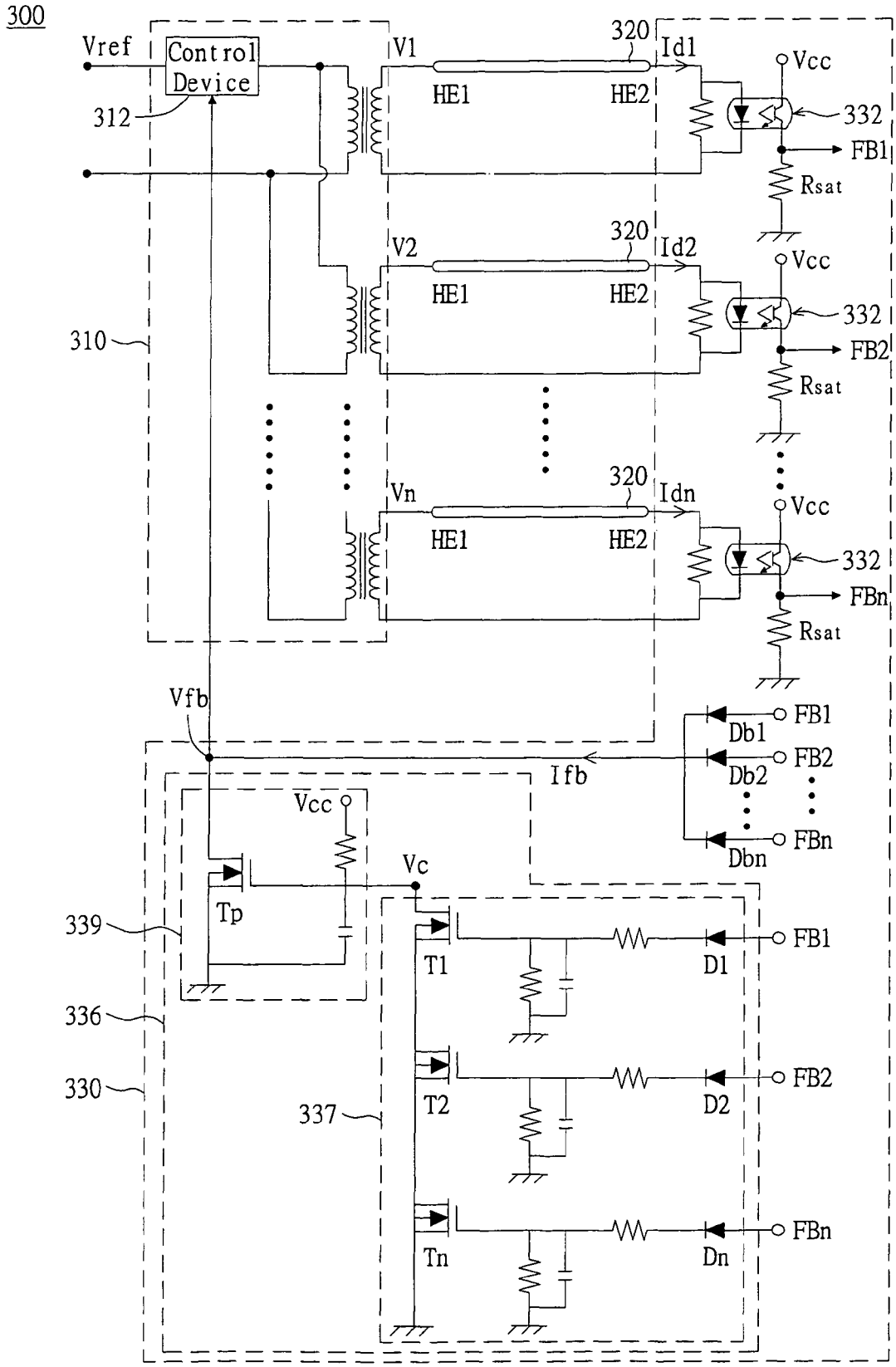
FIG. 3 is a circuit diagram of a backlight module including a feedback circuit according to another embodiment.

Referring to FIG. 3, a circuit diagram of a backlight module according to another embodiment of the invention is shown. The backlight module 300 includes an inverter 310, n (n is a positive integer) lamps 320 (e.g., floating lamps), and a feedback circuit 330. Each lamp 320 has two high-voltage ends HE1 and HE2. The inverter 310 is used for respectively outputting driving voltages V1~Vn to the n lamps 320. The inverter 310 has the same structure and connection relationship with the lamps 320 as the inverter 210 of the embodiment of FIG. 1.

In the FIG. 3 embodiment, the feedback circuit 330 includes n optical couplers 332 (to be used as current detectors to detect lamp currents), n diodes Db1~Dbn, and a protection unit 336. Each optical coupler 332 is connected between Vcc and an output node that produces Fbi (i=1~n). A respective resistor Rsat is connected between the output node of the optical coupler and ground. The n optical couplers 332 are connected to the high-voltage ends HE2 of the n lamps 320, respectively, and to the inverter 310 for receiving the corresponding lamp currents Id1~Idn. According to the lamp currents Id1~Idn, the optical couplers 332 output respective current signals FB1~FBn. The anodes of the n diodes Db1~Dbn receive respective current signals FB1~FBn, and the cathodes of the n diodes Db1~Dbn are connected together to provide a feedback voltage Vfb and feedback current Ifb.

The protection unit 336 further includes a feedback switch device 337 and a protection switch device 339 that are the same as the feedback switch device 237 and protection switch device 239, respectively, of FIG. 2. The feedback switch device 337 receives the current signals FB1~FBn and provides a control voltage Vc accordingly. The protection switch device 339 includes an NMOS transistor Tp for driving Vfb.

When all the lamps 320 are operated in a normal state (a conductive state), the n optical couplers 332 respectively output non-zero current signals FB1~FBn according to the lamp currents Id1~Idn. As with the feedback switch device 237 of FIG. 2, the non-zero current signals FB1~FBn turn on the feedback switch device 337 to cause the control voltage Vc to be grounded so that the transistor Tp is turned off. In this case, the collection of parallelly connected diodes Db1~Dbn drive a feedback current Ifb (equal to the maximum of FB1~Fbn) to cause a non-zero feedback voltage Vfb to be provided to the control device 312. The control device 312 can adjust the luminance of the lamps 320 according to the comparison of the feedback voltage Vfb and the reference voltage Vref.

However, if at least one (such as the second one) of the lamps 320 is non-functional (non-conductive), the corresponding lamp current Id2 is zero, and thus the current signal FB2 induced by the optical coupler 332 is also zero. The zero current signal FB2 causes the corresponding transistor T2 in the feedback switch device 337 to be off, which causes the whole feedback switch device 337 to be turned off. As a result, the transistor Tp in the protection switch device 339 is turned on so that the feedback voltage Vfb is grounded. The control device 312 detects the grounded Vfb and determines that the lamps 320 are in an abnormal condition and immediately stops outputting the lamp currents Id1~Idn to prevent the damage of the whole backlight module 300.

Figure 4:
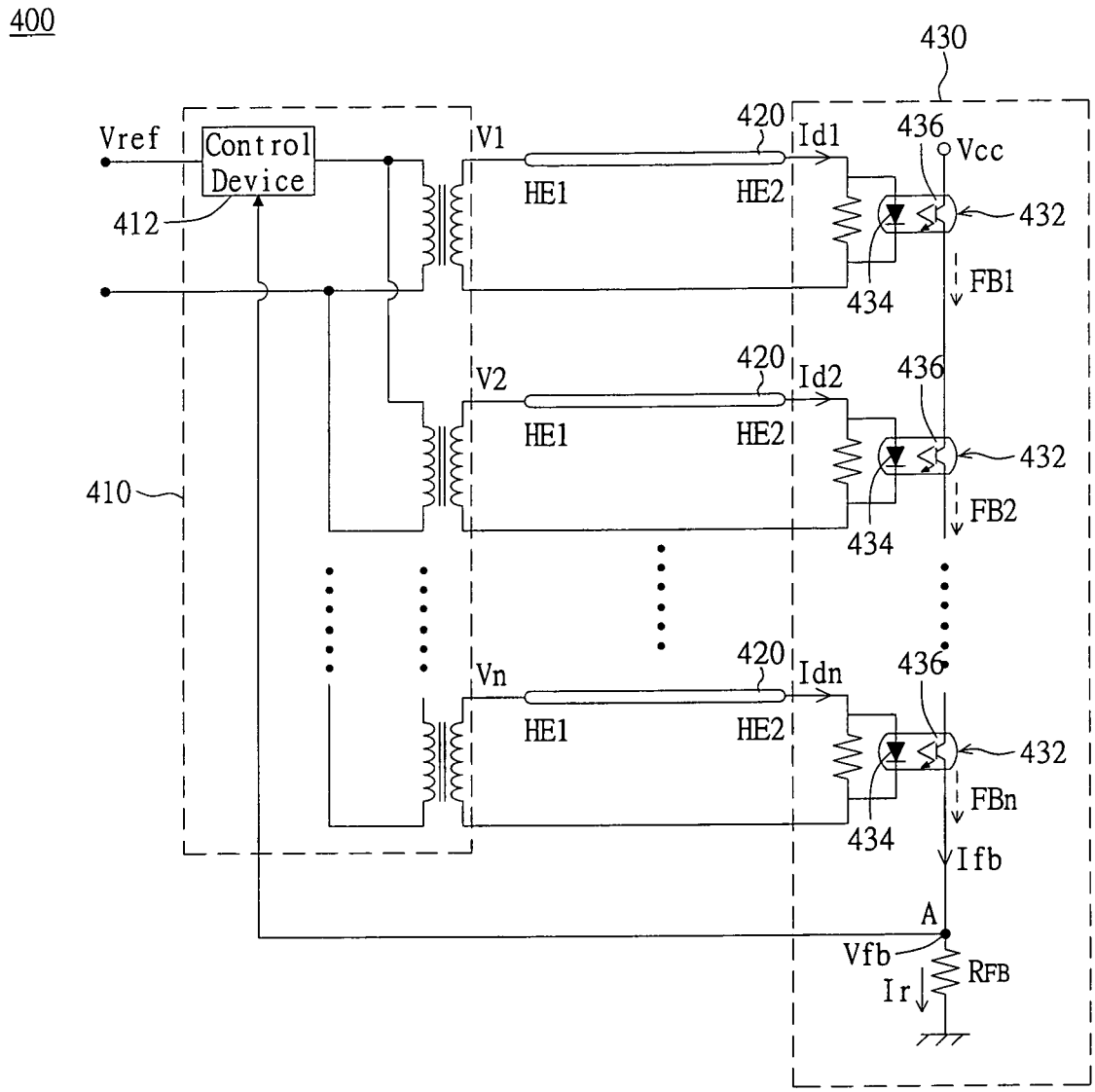
FIG. 4 is a circuit diagram of a backlight module including a feedback circuit according to yet another embodiment.

Referring to FIG. 4, a circuit diagram of a backlight module 400 according to yet another embodiment is shown. The backlight module 400 includes an inverter 410, n (n is a positive integer) lamps 420, and a feedback circuit 430. Each lamp 420 has two high-voltage ends HE1 and HE2. The inverter 410 is used for respectively outputting driving voltages V1~Vn to the n lamps 420. The inverter 410 has the same structure and connection relationship with the lamps 420 as the inverter 210 of the FIG. 2 embodiment.

Unlike the feedback circuit 330 of FIG. 3, the feedback circuit 430 includes n optical couplers 432 connected in series along with a resistor $R_{FB}$. In contrast, in the feedback circuit 330 of FIG. 3, the optical couplers 332 are connected in parallel to each other. Each optical coupler 432 includes a light emitting diode (LED) 434 and an optical detector 436. Each LED 434 is connected to the high-voltage end HE2 of the corresponding lamp 420 and the inverter 410. The first optical detector 436 in the series (the highest optical detector in FIG. 4) has an input connected to Vcc and an output (that produces FB1) connected to the input of the next optical detector 436 in the series. The last optical detector 436 in the series (the lowest optical detector in FIG. 4) has an input connected to the output of the previous optical detector 436 in the series and an output connected to a terminal (A) of resistor $R_{FB}$. Each of the intermediate optical detectors 432 (between the first and last optical detectors) has an output connected to the output of the previous optical detector in the series, and an output (that produces a corresponding one of FB2, . . . FBn−1) connected to the input of the next optical detector in the series. The resistor $R_{FB}$ is connected between node A and ground. The output of the last optical detector 436 provides feedback current Ifb (FBn), which causes generation of feedback voltage Vfb at node A, which is supplied to the control device 412.

When all the lamps 420 are operated in a normal state (a conductive state), the n optical couplers 432 respectively induce non-zero current signals FB1~FBn at the optical detectors 436 according to the lamp currents Id1~Idn. Since the optical detectors 436 are coupled to each other, the feedback current Ifb output by the last optical detector 436 is the minimum value of the current signals FB1~FBn, that is, Ifb=min {FB1, . . . , FBn}≠0. A part (Ir) of the current Ifb flows through the resistor RFB and thus the node A provides feedback voltage Vfb=Ir*RFB (≠0) to the control device 412. The control device 412 adjusts the luminance of the lamps 420 according to the comparison of the feedback voltage Vfb and the reference voltage Vref.

If at least one (such as the second one) of the lamps 420 is non-functional, the corresponding lamp current Id2 is zero, and thus the current signal FB2 induced by the optical coupler 432 is also zero. Since the feedback current Ifb is the minimum value of the current signals FB1~FBn, the feedback current Ifb is also zero. Consequently, the node A has a zero voltage and the feedback voltage Vfb is accordingly zero. In response, the control device 412 determines the lamps 420 are in an abnormal condition and immediately stops outputting the lamp currents Id1~Idn to prevent the damage of the whole backlight module 400.

According to the embodiments mentioned above, although the feedback circuit 230, 330 or 430 is arranged to connect to the high-voltage end HE2 of the lamp 220, 320 or 420, the feedback circuit 230, 330 or 430 can alternatively be connected to the other high-voltage end HE1 of the lamp 220, 320 or 420. Moreover, the feedback circuit according to other embodiments can also have another type of circuit structure, which can include other types of current detection devices to detect lamp currents.

In the lamp driving circuitry discussed above, the lamp currents at the high-voltage ends of the lamps are detected by current detectors, such as current transformers or optical couplers, to obtain respective current signals at the high-voltage ends. These current signals are used for feedback to the inverter. If at least one of the lamps is non-functional, a ground voltage is output provided for controlling the inverter to stop outputting the driving voltages. The circuitry according to some embodiments are able to provide more accurate feedback current and voltage signals. Also, the circuitry can be applied for use with any of single-drive, dual-drive, or floating lamps to increase flexibility.

Figure 5:
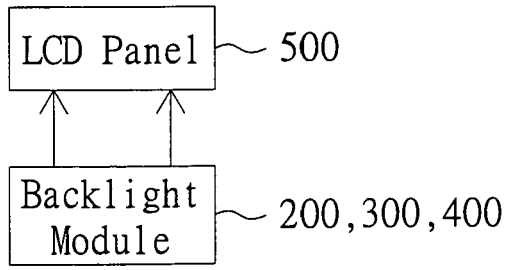
FIG. 5 illustrates a liquid crystal display (LCD) device that incorporates an embodiment.

The backlight module of any of FIGS. 2-4 can be used in an LCD module, such as the one depicted in FIG. 5. As depicted in FIG. 5, the backlight module 200, 300, 400 is positioned adjacent an LCD panel 500, which LCD panel has an liquid crystal layer and an active array substrate that controls the amount of light passing through different portions of the liquid crystal layer.

While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A lamp driving apparatus for use with a backlight module having a plurality of lamps, each lamp comprising at least a high-voltage end, the lamp driving apparatus comprising:

an inverter to output driving voltages to the corresponding lamps; and a feedback circuit connected to the high-voltage ends of the lamps to detect lamp currents of respective lamps, and to provide a feedback indication accordingly, wherein the inverter is configured to adjust the driving voltages according to the feedback indication, wherein the feedback circuit comprises:

a plurality of current detection devices, each of the current detection devices connected to the high-voltage end of the corresponding lamp to receive the corresponding lamp current and to output a respective current signal according to the lamp current, wherein the current detection devices comprise devices selected from current transformers and optical couplers; and a plurality of diodes, each of the diodes comprising an anode and a cathode, the anodes for respectively receiving the current signals, and the cathodes connected to each other for providing the feedback indication.

2. The lamp driving apparatus of claim 1, wherein each optical coupler comprises an optical detector, and wherein the optical detectors are arranged in parallel.

3. The lamp driving apparatus of claim 1, wherein each optical coupler comprises an optical detector, and wherein the optical detectors are connected in series.

4. The lamp driving apparatus of claim 1, further comprising a protection unit, wherein when the lamps are operating normally, the protection unit is switched off, and when at least one of the lamps is non-functional, the protection unit outputs a protection voltage and the inverter stops outputting the driving voltage in response to the protection voltage.

5. The lamp driving apparatus of claim 4, wherein the protection voltage comprises a ground voltage.

6. A lamp driving apparatus for use with a backlight module having a plurality of lamps, each lamp comprising at least a high-voltage end, the lamp driving apparatus comprising:

an inverter to output driving voltages to the corresponding lamps; and a feedback circuit connected to the high-voltage ends of the lamps to detect lamp currents of respective lamps, and to provide a feedback indication accordingly, wherein the inverter is configured to adjust the driving voltages according to the feedback indication, wherein the feedback circuit comprises:

a plurality of optical couplers respectively coupled to the lamps, each optical coupler comprising:

a light emitting diode (LED) connected to the high-voltage end of the corresponding lamp, to receive the corresponding lamp current; and an optical detector, wherein the optical detectors are connected in series; and a resistor having a first terminal connected to a ground voltage and a second terminal connected to the output end of the last one of the optical detectors in the series, the second terminal of the resistor providing the feedback indication.

7. The lamp driving apparatus of claim 6, wherein when at least one of the lamps is non-functional, the corresponding optical detector is switched off so that the voltage at the second terminal of the resistor is a ground voltage, and the inverter stops outputting the driving voltages in response to the ground voltage.

8. The lamp driving apparatus of claim 7, wherein when the lamps are operating normally, the last optical detector in the series outputs a feedback current to generate a feedback voltage at the second terminal of the resistor, and the inverter adjusts the driving voltages according to the feedback voltage.

9. A backlight module, comprising: a first lamp having at least a high-voltage end; a second lamp having at least a high-voltage end; an inverter to output a first driving voltage to the first lamp and a second driving voltage to the second lamp; and a feedback circuit connected to the high-voltage ends of the first and second lamps and having current detectors to detect lamp currents of the respective first and second lamps, the feedback circuit to output a feedback signal according to the lamp currents, wherein each of the current detectors comprises an optical coupler to detect the corresponding lamp current, and wherein the optical coupler has a light emitting diode and an optical detector, the light emitting diode connected to the high-voltage end of the corresponding lamp, and wherein the inverter is configured to adjust the driving voltages to the lamps according to the feedback signal that is according to the lamp currents.

10. The backlight module according to claim 9, wherein the feedback circuit further comprises:

diodes to receive a current signals from the optical couplers and to output the feedback signal.

11. The backlight module according to claim 10, further comprising a protection unit, wherein when the lamps are operating normally, the protection unit allows the feedback signal to be provided to the inverter to allow the inverter to adjust the driving voltages, and when at least one of the lamps is non-functional, the protection circuit sets the feedback signal to a protection voltage to disable the inverter.

12. The backlight module according to claim 9, wherein each of the lamps comprises a dual-drive lamp.

13. The backlight module according to claim 9, wherein each of the lamps comprises a single-drive lamp.

14. A liquid crystal display (LCD) device, comprising:

a liquid crystal panel; and a backlight module positioned adjacent the liquid crystal panel, the backlight module comprising:

a plurality of lamps to provide a backlight for the liquid crystal panel, wherein each of the lamps comprises at least one high voltage end;

an inverter to output driving voltages to respective lamps; and a feedback circuit having current detectors connected to the corresponding high-voltage ends of the lamps to detect corresponding lamp currents of the respective lamps and to output a feedback signal according to the lamp currents, wherein the inverter is configured to adjust the driving voltages according to the feedback signal, wherein the current detectors comprise current transformers or optical couplers, wherein the current detectors are to output corresponding current signals according to corresponding lamp currents, and wherein the feedback circuit further comprises: a plurality of diodes, each of the diodes comprising an anode and a cathode, the anodes to respectively receive the current signals, and the cathodes connected to each other to provide the feedback signal.

15. A method to produce light, comprising: providing lamps each having at least one high-voltage end; detecting lamp currents of the lamps using corresponding current detectors connected to the high-voltage ends of the lamps, each of the current detectors comprising an optical coupler having a light emitting diode connected to the high-voltage end of the corresponding lamp, and having an optical detector, generating a feedback signal by a feedback circuit according to the lamp currents, wherein the feedback circuit has a plurality of diodes having respective anodes to receive current signals from the corresponding current detectors, and having cathodes connected to each other to provide the feedback signal; and adjusting drive voltages to the lamps according to the feedback signal.

* * * * *